US008539920B2

(12) United States Patent
Meldolesi et al.

(10) Patent No.: US 8,539,920 B2
(45) **Date of Patent: *Sep. 24, 2013**

(54) VALVE LASH ADJUSTMENT SYSTEM FOR A SPLIT-CYCLE ENGINE

(75) Inventors: Riccardo Meldolesi, West Sussex (GB); Clive Lacy, West Sussex (GB); Anthony Perkins, West Sussex (GB); Ian Gilbert, West Sussex (GB)

(73) Assignee: Scuderi Group, Inc., West Springfield, MA (US)

( * ) Notice: Subject to any disclaimer, the term of this patent is extended or adjusted under 35 U.S.C. 154(b) by 409 days.

This patent is subject to a terminal disclaimer.

(21) Appl. No.: 12/690,514

(22) Filed: Jan. 20, 2010

(65) Prior Publication Data

US 2010/0180847 A1 Jul. 22, 2010

Related U.S. Application Data

(60) Provisional application No. 61/205,777, filed on Jan. 22, 2009.

(51) Int. Cl.
*F01L 1/18* (2006.01)

(52) U.S. Cl.
USPC ..... 123/90.43; 123/90.39; 123/90.16

(58) Field of Classification Search
USPC ..... 123/90.43, 90.39, 90.16, 90.48
See application file for complete search history.

(56) References Cited

U.S. PATENT DOCUMENTS

| | | | |
|---|---|---|---|
| 1,599,260 | A | 9/1926 | Willson |
| 1,936,653 | A | 11/1933 | Almen |
| 1,979,348 | A | 11/1934 | Russell |
| 2,109,809 | A | 3/1938 | Van Ranst |
| 2,111,734 | A | 3/1938 | Riley |
| 2,148,854 | A | 2/1939 | Bokemuller |
| 2,394,354 | A | 2/1946 | Barr |

(Continued)

FOREIGN PATENT DOCUMENTS

| | | | |
|---|---|---|---|
| CN | 101255808 | A | 9/2008 |
| EP | 1 148 213 | A1 | 10/2001 |

(Continued)

OTHER PUBLICATIONS

International Search Report issued on Mar. 23, 2010 in the corresponding PCT application PCT/US2010/021500.

(Continued)

*Primary Examiner* — Zelalem Eshete
(74) *Attorney, Agent, or Firm* — Nutter McClennen & Fish LLP; John J. Penny, Jr.; Michael P. Visconti, III

(57) ABSTRACT

The present invention provides a valve actuation system comprising a valve train for actuating a valve, the valve train including actuating elements and a valve lash, and a valve lash adjustment system for adjusting the valve lash, wherein the valve train and the valve lash adjustment system do not share any common actuating elements.

34 Claims, 14 Drawing Sheets

(56) References Cited

U.S. PATENT DOCUMENTS

| | | | | |
|---|---|---|---|---|
| 2,772,667 | A | 12/1956 | Nallinger | |
| 2,772,687 | A | 12/1956 | Wunsch et al. | |
| 2,851,023 | A | 9/1958 | Durkan | |
| 3,087,478 | A | 4/1963 | Fairchild | |
| 4,825,717 | A | 5/1989 | Mills | |
| 5,018,487 | A | 5/1991 | Shinkai | |
| 5,035,959 | A * | 7/1991 | Ito et al. | 428/627 |
| 6,152,714 | A | 11/2000 | Mitsuya et al. | |
| 6,543,225 | B2 | 4/2003 | Scuderi | |
| 6,952,923 | B2 | 10/2005 | Branyon et al. | |
| 7,171,930 | B2 | 2/2007 | Keel | |
| 2005/0022768 | A1 | 2/2005 | Tores et al. | |
| 2008/0202456 | A1 | 8/2008 | Diggs | |
| 2010/0180848 | A1 | 7/2010 | Meldolesi | |

FOREIGN PATENT DOCUMENTS

| | | | |
|---|---|---|---|
| GB | 289468 | A | 7/1929 |
| GB | 2138498 | A | 10/1984 |
| JP | 59-136509 | A | 8/1984 |
| JP | 59-150911 | U | 10/1984 |
| JP | 60-001311 | A | 1/1985 |
| JP | 05-280312 | A | 10/1993 |
| JP | 10-103028 | A | 4/1998 |
| KR | 10 2005 0077481 | A | 8/2005 |
| KR | 10 2006 0107855 | A | 10/2006 |
| KR | 10 2006 0107856 | A | 10/2006 |

OTHER PUBLICATIONS

"Tuning and Maintenance of M.G.s", p. 12, Philip H. Smith, A.M.I. Mech.E., 1938.

"The illustrated Catalogue of Spares", Seventh Edition, Sports & Vintage Motors (Shrewsbury) Limited, 1990.

"Hydraulic valve lash adjustment elements", INA p. 4-11, 1996.

International Preliminary Report on Patentability issued Jul. 26, 2011 in the corresponding PCT Application No. PCT/US2010/021500.

Extended European Search Report issued Oct. 19, 2012 for Application No. 10733809.7 (8 Pages).

Canadian Office Action for Application No. 2750550, issued Mar. 18, 2013. (3 pages).

Chinese Office Action issued Nov. 5, 2012 for Application No. 201080004920.0 (7 pages).

Korean Office Action issued Oct. 30, 2012 for Application No. 10-2011-7019198 (10 pages).

Chilean Office Action issued Nov. 15, 2012 for Application No. 1657-2011 (23 pages).

Japanese Office Action for Application No. 2011-548070, issued Mar. 26, 2013 (8 pages).

Korean Notice of Allowance for Application No. 10-2011-7019198, issued Apr. 25, 2013 (4 pages).

* cited by examiner

VALVE LASH ADJUSTMENT SYSTEM FOR A SPLIT-CYCLE ENGINE

Priority is claimed under 35 U.S.C. §119(e) to U.S. Provisional Application No. 61/205,777 filed on Jan. 22, 2009, which is hereby incorporated by reference it its entirety.

TECHNICAL FIELD

The present invention relates generally to a valve lash adjustment system and a valve actuation system for a valve of an internal combustion engine. More specifically, the present invention relates to a valve lash adjustment system for a valve of a split-cycle engine.

BACKGROUND OF THE INVENTION

For purposes of clarity, the term "conventional engine" as used in the present application refers to an internal combustion engine wherein all four strokes of the well known Otto cycle (the intake, compression, expansion and exhaust strokes) are contained in each piston/cylinder combination of the engine. Each stroke requires one half revolution of the crankshaft (180 degrees crank angle (CA)), and two full revolutions of the crankshaft (720 degrees CA) are required to complete the entire Otto cycle in each cylinder of a conventional engine.

Also, for purposes of clarity, the following definition is offered for the term "split-cycle engine" as may be applied to engines disclosed in the prior art and as referred to in the present application.

A split-cycle engine comprises:

a crankshaft rotatable about a crankshaft axis;

a compression piston slidably received within a compression cylinder and operatively connected to the crankshaft such that the compression piston reciprocates through an intake stroke and a compression stroke during a single rotation of the crankshaft;

an expansion (power) piston slidably received within an expansion cylinder and operatively connected to the crankshaft such that the expansion piston reciprocates through an expansion stroke and an exhaust stroke during a single rotation of the crankshaft; and a crossover passage interconnecting the compression and expansion cylinders, the crossover passage including a crossover compression (XovrC) valve and a crossover expansion (XovrE) valve defining a pressure chamber therebetween.

U.S. Pat. No. 6,543,225 granted Apr. 8, 2003 to Carmelo J. Scuderi (the Scuderi patent) and U.S. Pat. No. 6,952,923 granted Oct. 11, 2005 to David P. Branyon et al. (the Branyon patent) each contain an extensive discussion of split-cycle and similar type engines. In addition the Scuderi and Branyon patents disclose details of prior versions of engines of which the present invention comprises a further development. Both the Scuderi patent and the Branyon patent are incorporated herein by reference in their entirety.

Referring to FIG. 1, a prior art split-cycle engine of the type similar to those described in the Branyon and Scuderi patents is shown generally by numeral 10. The split-cycle engine 10 replaces two adjacent cylinders of a conventional engine with a combination of one compression cylinder 12 and one expansion cylinder 14. The four strokes of the Otto cycle are "split" over the two cylinders 12 and 14 such that the compression cylinder 12 contains the intake and compression strokes and the expansion cylinder 14 contains the expansion and exhaust strokes. The Otto cycle is therefore completed in these two cylinders 12, 14 once per crankshaft 16 revolution (360 degrees CA).

During the intake stroke, intake air is drawn into the compression cylinder 12 through an inwardly opening (opening inward into the cylinder) poppet intake valve 18. During the compression stroke, compression piston 20 pressurizes the air charge and drives the air charge through the crossover passage 22, which acts as the intake passage for the expansion cylinder 14.

Due to very high volumetric compression ratios (e.g., 20 to 1, 30 to 1, 40 to 1, or greater) within the compression cylinder 12, an outwardly opening (opening outward away from the cylinder) poppet crossover compression (XovrC) valve 24 at the crossover passage inlet is used to control flow from the compression cylinder 12 into the crossover passage 22. Due to very high volumetric compression ratios (e.g., 20 to 1, 30 to 1, 40 to 1, or greater) within the expansion cylinder 14, an outwardly opening poppet crossover expansion (XovrE) valve 26 at the outlet of the crossover passage 22 controls flow from the crossover passage 22 into the expansion cylinder 14. The actuation rates and phasing of the XovrC and XovrE valves 24, 26 are timed to maintain pressure in the crossover passage 22 at a high minimum pressure (typically 20 bar or higher) during all four strokes of the Otto cycle.

A fuel injector 28 injects fuel into the pressurized air at the exit end of the crossover passage 22 in correspondence with the XovrE valve 26 opening. The fuel-air charge fully enters the expansion cylinder 14 shortly after expansion piston 30 reaches its top dead center position. As piston 30 begins its descent from its top dead center position, and while the XovrE valve 26 is still open, spark plug 32 is fired to initiate combustion (typically between 10 to 20 degrees CA after top dead center of the expansion piston 30). The XovrE valve 26 is then closed before the resulting combustion event can enter the crossover passage 22. The combustion event drives the expansion piston 30 downward in a power stroke. Exhaust gases are pumped out of the expansion cylinder 14 through inwardly opening poppet exhaust valve 34 during the exhaust stroke.

With the split-cycle engine concept, the geometric engine parameters (i.e., bore, stroke, connecting rod length, compression ratio, etc.) of the compression and expansion cylinders are generally independent from one another. For example, the crank throws 36, 38 for the compression cylinder 12 and expansion cylinder 14 respectively may have different radii and may be phased apart from one another with top dead center (TDC) of the expansion piston 30 occurring prior to TDC of the compression piston 20. This independence enables the split-cycle engine to potentially achieve higher efficiency levels and greater torques than typical four stroke engines.

The actuation mechanisms (not shown) for crossover valves 24, 26 may be cam driven or camless. In general, a cam driven mechanism includes a camshaft mechanically linked to the crankshaft. A cam is mounted to the camshaft, and has a contoured surface that controls the valve lift profile of the valve opening event [i.e., the event that occurs during a valve actuation]. A cam driven actuation mechanism is efficient, fast and may be part of a variable valve actuation system, but generally has limited flexibility.

For purposes herein a valve opening event is defined as the valve lift from its initial opening off of its valve seat to its closing back onto its valve seat versus rotation of the crankshaft during which the valve lift occurs. Also for purposes herein the valve opening event rate [i.e., the valve actuation rate] is the duration in time required for the valve opening event to occur within a given engine cycle. It is important to note that a valve opening event is generally only a fraction of the total duration of an engine operating cycle, e.g., 720 CA degrees for a conventional engine cycle and 360 CA degrees for a split-cycle engine.

Also in general, camless actuation systems are known, and include systems that have one or more combinations of mechanical, hydraulic, pneumatic, and/or electrical components or the like. Camless systems allow for greater flexibility during operation, including, but not limited to, the ability to change the valve lift height and duration and/or deactivate the valve at selective times.

Referring to FIG. 2, an exemplary prior art valve lift profile 40 for a crossover valve in a split-cycle engine is shown. Valve lift profile 40 can potentially be applied to either or both of crossover valves 24, 26 in FIG. 1. Valves 24 and 26 will be referred to below as having the same valve lift profile 40 merely for purposes of discussion.

Regardless of whether valves 24 and 26 are cam driven or actuated with a camless system, the valve lift profile 40 needs to be controlled to avoid damaging impacts when the valves 24, 26 are approaching their closed positions against their valve seats. Accordingly, a portion of the profile 40—referred to herein as the "landing" ramp 42—may be controlled to rapidly decelerate the velocity of the valves 24, 26 as they approach their valve seats. The valve lift at the start of maximum deceleration (on the descending side of the profile 40) is defined herein as the landing ramp height 44. The landing ramp duration 46 is defined herein as the duration of time from the start of the maximum deceleration of the moving valve to the point of landing on the valve seat. The velocity of the valve 24 or 26 when the valve contacts the valve seat is referred to herein as the seating velocity. For purposes herein, the "takeoff" ramp 45 is not as critical as the landing ramp 42, and can be set to any value that adequately achieves the maximum lift 48.

In cam-driven actuation systems, the landing ramp is generated by the profile of the cam. Accordingly, the landing ramp's duration in time is proportional to the engine speed, while its duration relative to crankshaft rotation (i.e., degrees CA) is generally fixed. In camless actuation systems, in general, the landing ramp is actively controlled by a valve seating control device or system.

For split-cycle engines which ignite their charge after the expansion piston reaches its top dead center position (such as in the Scuderi and Branyon patents), the dynamic actuation of the crossover valves 24, 26 is very demanding. This is because the crossover valves 24 and 26 of engine 10 must achieve sufficient lift to fully transfer the fuel-air charge in a very short period of crankshaft rotation (generally in a range of about 30 to 60 degrees CA) relative to that of a conventional engine, which normally actuates the valves for a period of at least 180 degrees CA. This means that the crossover valves 24, 26 must actuate about four to six times faster than the valves of a conventional engine.

As a consequence of the faster actuation requirements, the XovrC and XovrE valves 24, 26 of the split-cycle engine 10 have a severely restricted maximum lift (48 in FIG. 2) compared to that of valves in a conventional engine. Typically the maximum lift 48 of these crossover valves 24, 26 are in the order of 2 to 3 millimeters, as compared to about 10-12 mm for valves in a conventional engine. Consequently, both the height 44 and duration 46 of the landing ramp 42 for the XovrC and XovrE valves 24, 26, need to be minimized to account for the shortened maximum lift and faster actuation rates.

Problematically, the heights 44 of the landing ramps 42 of crossover valves 24 and 26 are so restricted that unavoidable variations in parameters that control ramp height, which are normally less significant in their effect on the larger lift profiles of conventional engines, now become critical. These parameter variations may include, but are not limited to:

1) dimensional changes due to thermal expansion of the metal valve stem and other metallic components in the valve's actuation mechanism as engine operational temperatures vary;
2) the normal wear of the valve and valve seat during the operational life of the valve;
3) manufacturing and assembly tolerances; and
4) variations in the compressibility (and resulting deflection) of hydraulic fluids (e.g. oil) in any components of the valvetrain (mainly caused by aeration).

Referring to FIG. 3, an exemplary embodiment of a conventional cam-driven valve train 50 for a conventional engine is illustrated. For purposes herein, a valve train of an internal combustion engine is defined as a system of valve train elements, which is used to control the actuation of the valves. The valve train elements generally comprise a combination of actuating elements and their associated support elements. Also for purposes herein, the primary motion of any valve train element is defined as that motion which the element would substantially experience when the elements of the valve train are idealized to have an infinite stiffness. The actuating elements (e.g., cams, tappets, springs, rocker arms, valves and the like) are used to directly impart the primary actuation motion to the valves (i.e., to actuate the valves) of the engine during each valve opening event of the valves. Accordingly, the primary motion of the individual actuating elements in a valve train must operate at the substantially same actuation rates as the valve opening events of the valves that the actuating elements actuate. The support elements (e.g., shafts, pedestals or the like) are used to securely mount and guide the actuating elements to the engine and generally have no primary motion, although they affect the overall stiffness of the valve train system. However, the primary motion, if any, of the support elements in a valve train operate at slower rates than the valve opening events of the valves.

It should be noted that support elements may be subject to some high frequency vibration primarily caused by the high frequency movements of the actuating elements of a valve train, which apply forces to the support elements during operation. The high frequency vibrations are a consequence of the actuating and support elements of the valve train having a finite stiffness, and are not part of the primary motion. However, the displacement induced by this vibration alone will have a magnitude that is substantially less than the magnitude of the primary motion of the actuating elements in the valve train, typically by an order of magnitude or less.

Valve train 50 actuates an inwardly opening poppet valve 52 having a valve head 54 and a valve stem 56. Located at the distal end of the valve stem 56 is the valve tip 58, which abuts against a tappet 60. Spring 62 holds the valve head 54 securely against a valve seat 64 when the valve 52 is in its closed position. Cam 66 rotates to act against the tappet 60 in order to depress spring 62 and lift the valve head 54 off of its valve seat 64. In this exemplary embodiment, valve 52, spring 62, tappet 60 and cam 66 are actuating elements. Though no associated support elements are illustrated, one skilled in the art would recognize that they would be required. Cam 66 includes a cylindrical portion, generally referred to as the base circle 68, which does not impart any linear motion to the valve 52. Cam 66 also includes a lift (or eccentric) portion 70 that imparts the linear motion to the valve 52. The contour of the cam's eccentric portion 70 controls the lift profile of valve 52. The effects of the aforementioned dimensional changes due to thermal expansion are compensated for by including a preset clearance space (or clearance) 72.

For purposes herein, the terms "valve lash" or "lash": are defined as the total clearance existing within a valve train when the valve is fully seated. The valve lash is equal to the total contribution of all the individual clearances between all individual valve train elements (i.e., actuating elements and support elements) of a valve train In this particular embodiment, the clearance 72 is the distance between the base circle 68 of cam 66 and the tappet 60. Also note that, in this particular embodiment, the clearance 72 is substantially equal to the valve lash of the valve train, i.e., the total contribution of all the clearances that exist between the valve's distal tip 58, when the valve 52 is fully seated on the valve seat 64, and the cam 66.

To compensate for the thermal effects on the inwardly opening valve 52, the clearance 72 is set at its maximum tolerance when the engine is cold. When the engine heats up, the valve's stem 56 will expand in length and reduce the clearance 72, but will not abut against the cam's base circle 68 (i.e., will not reduce the clearance 72 to zero). Accordingly, as the clearance 72 is reduced, valve 52 is extended further into the cylinder (not shown) when the valve 52 is open. Note however that, even as the clearance 72 is reduced, valve 52 remains seated against its valve seat when the valve 52 is closed.

However, as mentioned above, crossover valves, such as valves 24, 26 in split-cycle engine 10, have lift profiles that include much smaller landing ramp heights compared to that of a conventional engine. This would be true whether the valves were inwardly opening or outwardly opening, so long as the duration of valve actuation [i.e., the valve opening event] was short relative to that of a valve on a conventional engine, for example, a valve with a duration of actuation of approximately 3 ms and 180 degrees of crank angle, or less. In the case of such fast actuating, cam driven, inwardly opening valves, the valve's distal tip must engage the cam's landing ramps in order to have a controlled landing and safe seating velocity, and any fixed valve lash for such inwardly opening crossover valves must necessarily be set proportionally small. Problematically, variations in a set valve lash due to thermal expansion effects may actually be greater than the ramp height required for such valves. This means that if the valve lash is set large enough to account for thermal expansion, the tips of these inwardly opening crossover valves could miss the landing ramp altogether, which would cause the valves to repeatedly crash against their valve seats and prematurely damage the valves. Additionally, if the valve lash is set small enough to guarantee engagement with the landing ramp at all operating temperatures, the tips of the valves could expand enough to abut against the base circle of the cam, which would force the inwardly opening crossover valves open even when the valves should be in their closed position.

Moreover, the large lash setting would generate a shorter valve lift duration and the small lash setting would generate a lengthened valve lift duration. In either case, the range of variation of the valve opening event can be larger than desirable. It is desirable to contain the range of the valve opening event to a manageable level.

Referring to FIG. 4, an exemplary embodiment of a conventional engine cam driven valve train 73 having an automatically adjustable valve lash is illustrated. The valve train 73 actuates inwardly opening poppet valve 74. The valve train 73 includes cam 76, pivoting lever arm 78 and spring 80 as valve train actuating elements which actuate valve 74 during each cycle. The effects of thermal expansion and other parameters mentioned above are addressed by adding a lash adjuster assembly. For the lash adjuster assembly, an active lash control device, such as a hydraulic lash adjuster (HLA) 82 has been used. The hydraulic lash adjuster (HLA) 82 also functions as a support element associated with lever arm 78. As is known in the art, as valve lash in the valve train varies, HLA 82 hydraulically adjusts the position of lever arm 78 to compensate and bring the valve lash to zero (in this particular embodiment, the valve lash would be any clearance between the cam 76 and the lever arm 78, as well as any clearance between the lever arm 78 and the distal tip of the stem of valve 74).

Because lever arm 78 is one of the valve train 73 actuating elements (i.e., is an element that directly actuates the inwardly opening valve 74 during each cycle and is used to directly impart the primary actuation motion to the valve 74), there is an unavoidable tradeoff between the lever arm's minimum mass required for adequate stiffness (ratio of force applied to a point on the lever arm to the deflection of that point caused by that force) and the maximum mass allowable for high speed operation. That is, if the mass of lever arm 78 is too small, it will not be able to actuate valve 74 without undue bending and/or deformation. Additionally, if the mass of lever arm 78 is too large, it will be too heavy to actuate valve 74 at its maximum operating speed. For any particular valve train actuating element, if the minimum mass required for adequate stiffness exceeds the maximum mass allowable for maximum operating speed, the element cannot be used in the valve train. Generally, in a conventional engine, the requirements for stiffness and speed are not so demanding as to preclude the use of lever arm 78 in valve train 73.

However, as mentioned above, crossover valves 24, 26 must actuate about four to six times faster than the valves of a conventional engine, which means the actuating elements of the valve train system must operate at extremely high and rapidly changing acceleration levels relative to that of a conventional engine. These operating conditions would severely restrict the maximum mass of lever arm 78 in valve train 73.

Additionally, crossover valves 24, 26 must open against very high pressures in the crossover passage 22 compared to that of a conventional engine (e.g., 20 bar or higher), which exacerbates the stiffness requirements on the valve train system. Also, bending is a problem on elements such as lever arm 78 because the actuation force in one direction is concentrated in the median section of the element (i.e., where cam 76 engages lever arm 78) and all opposing reactionary forces are concentrated at the end sections of the lever arm (i.e., where HLA 82 and the tip of valve 74 engage opposing ends of lever arm 78). Moreover, this bending problem would increase proportionally as the length of the lever arm 78 increases. Accordingly, if the engine illustrated in prior art FIG. 4 were subjected to the higher pressures and severe actuation rates encountered in split-cycle engine 10, the stiffness and mass of lever arm 78 in valve train 73 would have to be substantially increased, therefore restricting the overall actuation rate of valve train 73.

Generally too, prior art HLAs (such as HLA 82), because of the compressibility of oil contained therein, are normally one of the main contributing factors in reducing valve train stiffness which, in turn, limits the maximum engine operating speed at which the valve train can safely operate. Therefore, a prior art HLA 82 connected to a lever arm 78, as shown in valve train 73, cannot be implemented with the split cycle engine 10, in which the valves need to actuate much more rapidly, and the HLA 82 must be much stiffer than those in a conventional engine.

There is a need therefore, for a valve lash adjustment system for cam driven valves of a split-cycle engine, which can both (a) handle the high speed and stiffness requirements necessary to safely actuate the valves; and (b) automatically compensate for such unavoidable factors as thermal expansion of actuation components, valve wear, and manufacturing tolerances that cause variations in the lash.

SUMMARY OF THE INVENTION

A valve actuation system (150) comprising a valve train (152) for actuating a valve (132/134), the valve train (152) including actuating elements (161, 162, 132/134) and a valve lash (178, 180); and a valve lash adjustment system (160) for adjusting the valve lash (178, 180), wherein said valve train (152) and said valve lash adjustment system (160) do not share any common actuating elements.

DETAILED DESCRIPTION OF THE INVENTION

Figure 1:
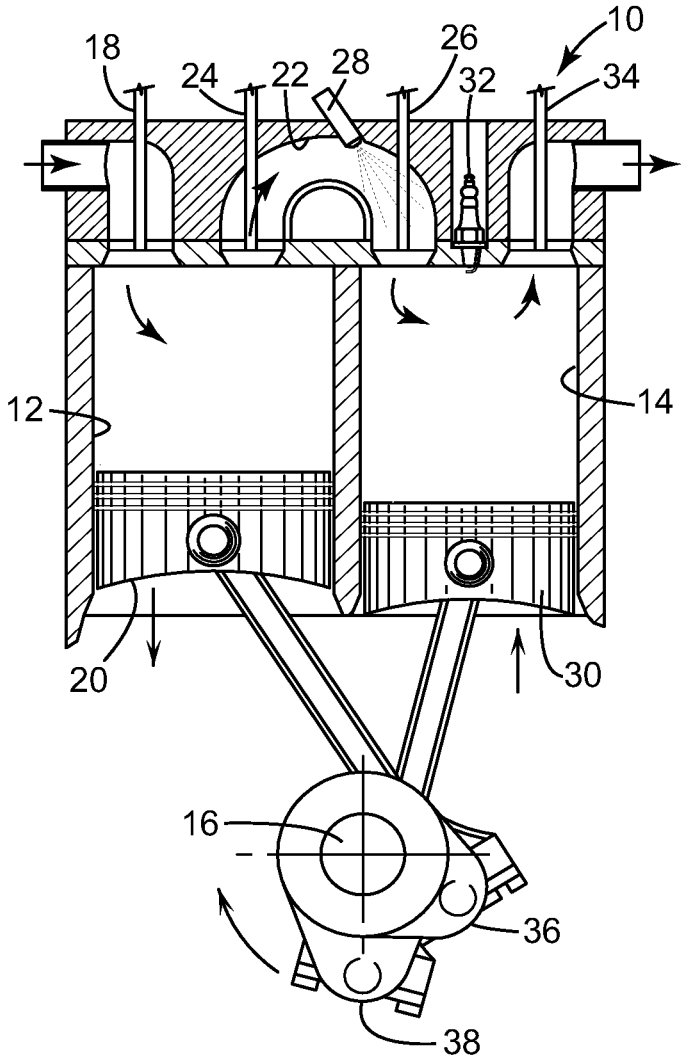
FIG. 1 Prior Art
FIG. 1 is a schematic cross-sectional view of a prior art split-cycle engine related to the engine of the invention.
Figure 2:
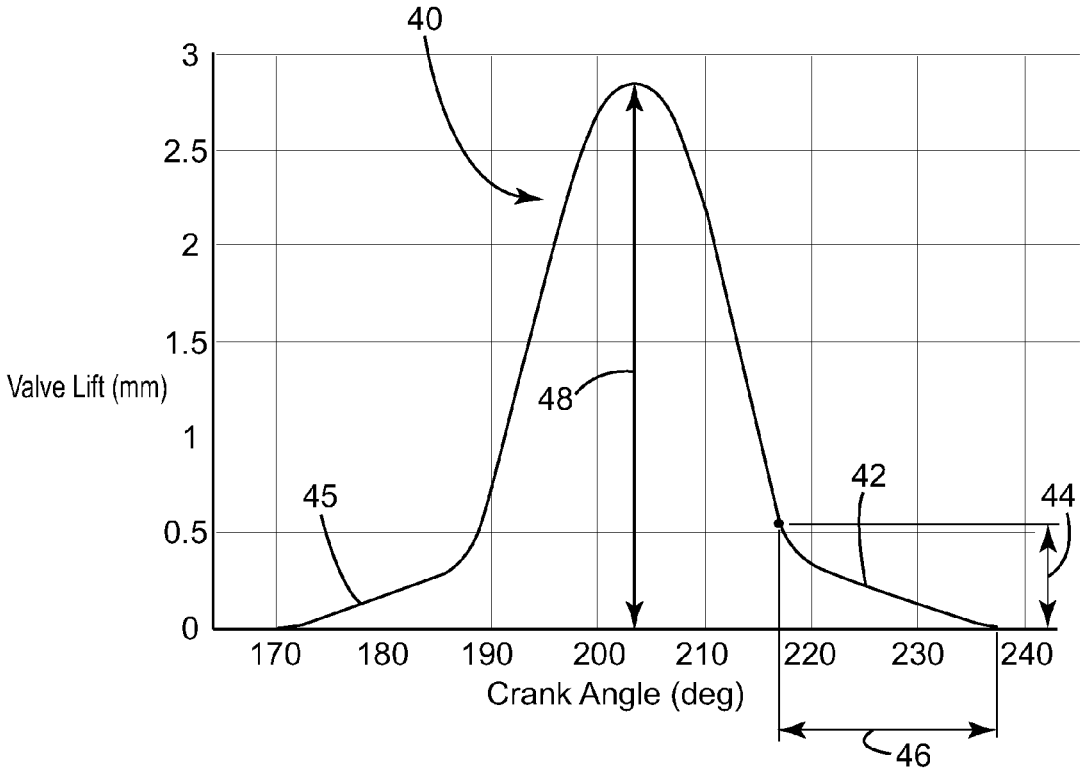
FIG. 2 Prior Art
FIG. 2 shows an exemplary prior art valve lift profile for a cross-over valve in a split-cycle engine.
Figure 3:
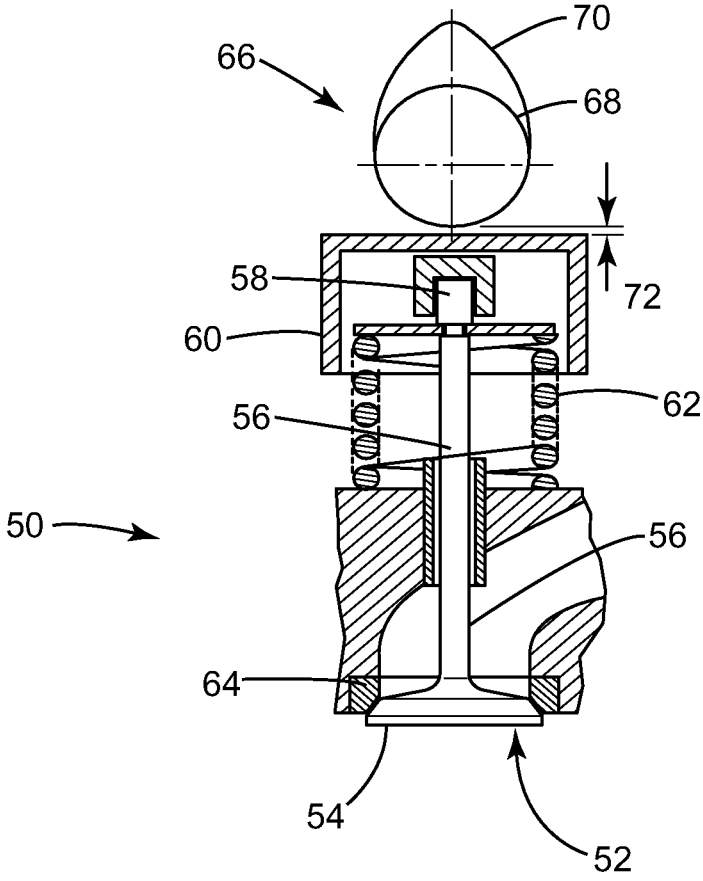
FIG. 3 Prior Art
FIG. 3 shows a prior art cam-driven valve train of a conventional engine.
Figure 4:
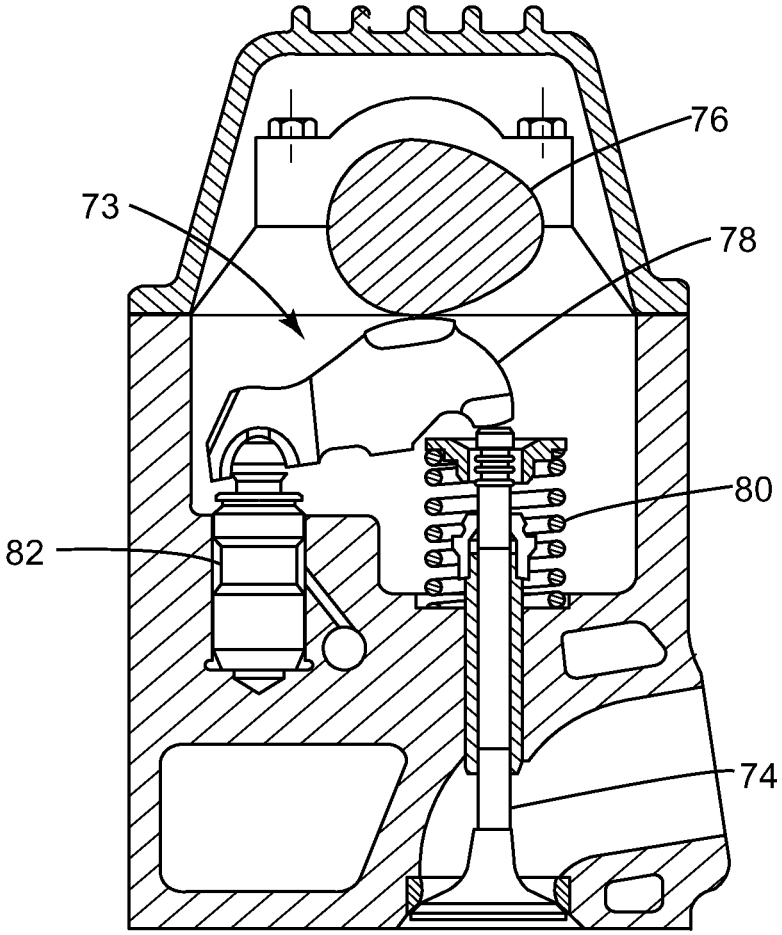
FIG. 4 Prior Art
FIG. 4 is a schematic cross-sectional view of a prior art hydraulic valve lash adjustment system, which uses a finger lever pivot element
Figure 5:
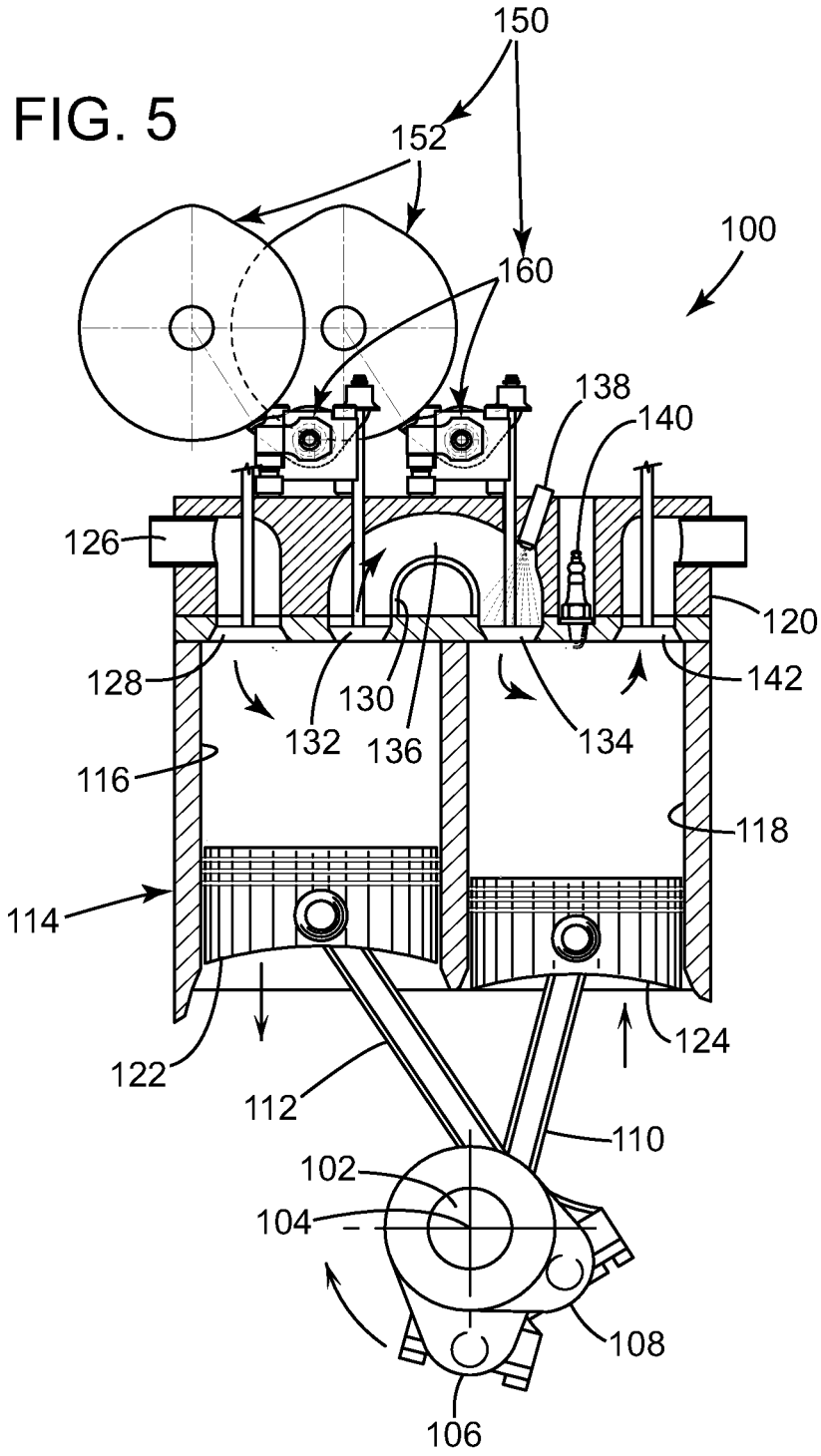
FIG. 5 shows an exemplary embodiment of the valve lash adjustment system of the invention mounted on a split-cycle engine.

Referring to FIG. 5, numeral 100 generally indicates a diagrammatic representation of an exemplary embodiment of a split-cycle engine according to the present invention. Engine 100 includes a crankshaft 102 rotatable about a crankshaft axis 104 in a clockwise direction as shown in the drawing. The crankshaft 102 includes adjacent angularly displaced leading and following crank throws 106, 108, connected to connecting rods 110, 112, respectively.

Engine 100 further includes a cylinder block 114 defining a pair of adjacent cylinders, in particular a compression cylinder 116 and an expansion cylinder 118 closed by a cylinder head 120 at one end of the cylinders opposite the crankshaft 102. A compression piston 122 is received in compression cylinder 116 and is connected to the connecting rod 112 for reciprocation of the piston 122 between top dead center (TDC) and bottom dead center (BDC) positions. An expansion piston 124 is received in expansion cylinder 118 and is connected to the connecting rod 110 for similar TDC/BDC reciprocation. The diameters of the cylinders 116, 118 and pistons 122, 124 and the strokes of the pistons 122, 124 and their displacements need not be the same.

Cylinder head 120 provides the means for gas flow into, out of and between the cylinders 116 and 118. The cylinder head 120 includes an intake port 126 through which intake air is drawn into the compression cylinder 116 through an inwardly opening poppet intake valve 128 during the intake stroke. During the compression stroke, compression piston 122 pressurizes the air charge and drives the air though a crossover (Xovr) passage 130, which acts as the intake passage for the expansion cylinder 118.

Due to very high compression ratios (e.g., 20 to 1, 30 to 1, 40 to 1, or greater) within the compression cylinder 116, an outwardly opening poppet crossover compression (XovrC) valve 132 at the crossover passage inlet is used to control flow from the compression cylinder 116 to the crossover passage 130. Due to very high compression ratios (e.g., 20 to 1, 30 to 1, 40 to 1, or greater) within the expansion cylinder 118, an outwardly opening poppet crossover expansion (XovrE) valve 134 at the outlet of the crossover passage 130 controls flow from the crossover passage 130 into the expansion cylinder 118. Crossover compression valve 132, crossover expansion valve 134 and crossover passage 130 define a pressure chamber 136 in which pressurized gas (typically 20 bar or greater) is stored between closing of the crossover expansion (XovrE) valve 134 during the expansion stroke of the expansion piston 124 on one cycle (crank rotation) of the engine 100 and opening of the crossover compression (XovrC) valve 132 during the compression stroke of the compression piston 122 on the following cycle (crank rotation) of the engine.

A fuel injector 138 injects fuel into the pressurized air at the exit end of the crossover passage 130 in correspondence with the XovrE valve 134 opening. The fuel-air charge enters the expansion cylinder 118 shortly after expansion piston 124 reaches its top dead center position. As piston 124 begins its descent from its top dead center position, and while the XovrE valve 134 is still open, spark plug 140 is fired to initiate combustion (typically between 10 to 20 degrees CA after top dead center of the expansion piston 124). The XovrE valve 134 is then closed before the resulting combustion event can enter the crossover passage 130. The combustion event drives the expansion piston 124 downward in a power stroke. Exhaust gases are pumped out of the expansion cylinder 118 through inwardly opening poppet exhaust valve 142 during the exhaust stroke.

The actuation mechanisms (not shown) for inlet valve 128 and exhaust valve 142 may be any suitable cam driven or camless system. Crossover compression and crossover expansion valves 132, 134 may also be actuated in any suitable manner. However, in accordance with the invention, preferably both crossover valves 132 and 134, are actuated by a cam-driven actuation system 150. Actuation system 150 comprises a valve train 152 that includes required actuating elements that are used to directly impart the primary actuation motion to the valves 132, 134, and a separate valve lash adjustment system 160 mounted remotely from the valve train 152. More specifically, the valve lash adjustment system 160 includes no actuating elements that are shared with the valve train 152, and no element of the lash adjustment system 160 is used to directly impart the primary actuation motion of the valves 132 and 134.

Figure 6:
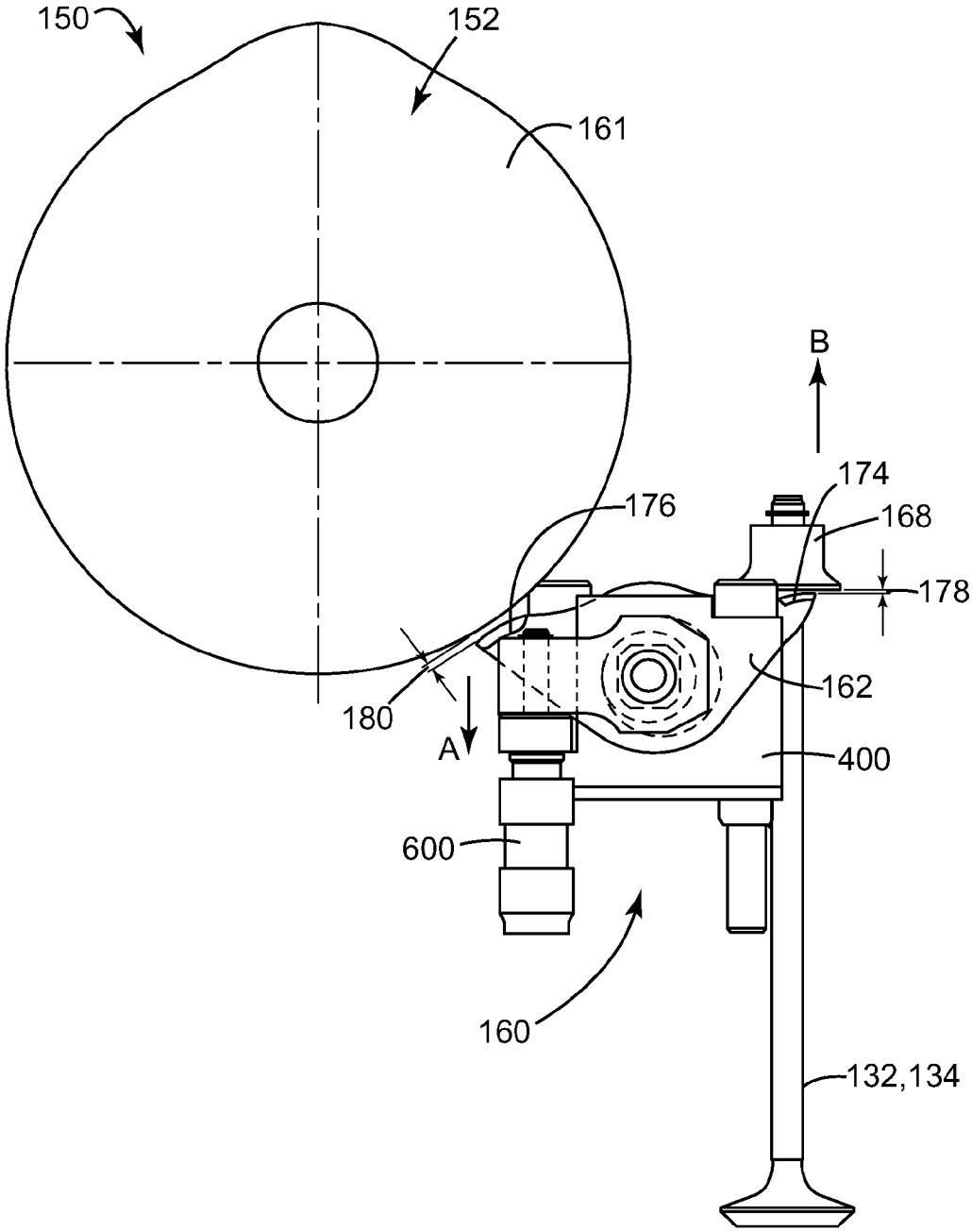
FIGS. 6, 7 and 8 show a side view, perspective view and exploded view, respectively, of an exemplary embodiment of the valve lash adjustment system and valve train of the invention.
Figure 7:
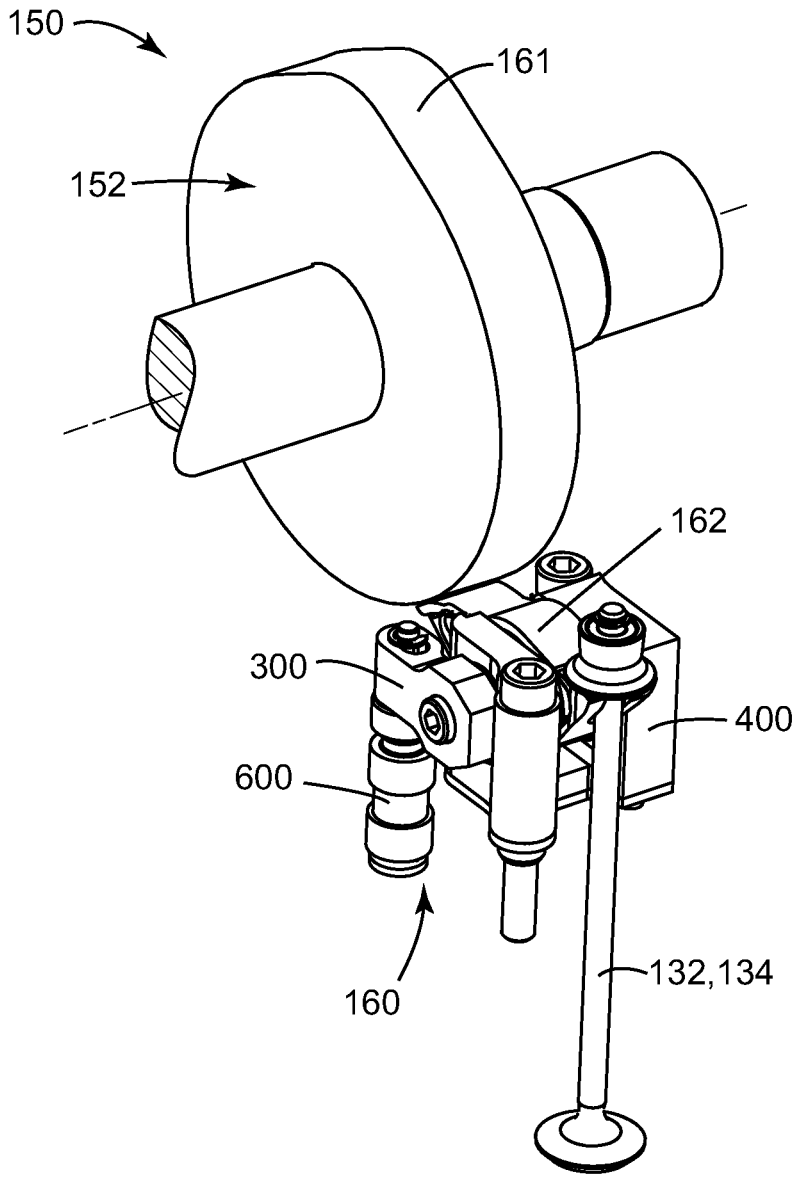
Figure 8:
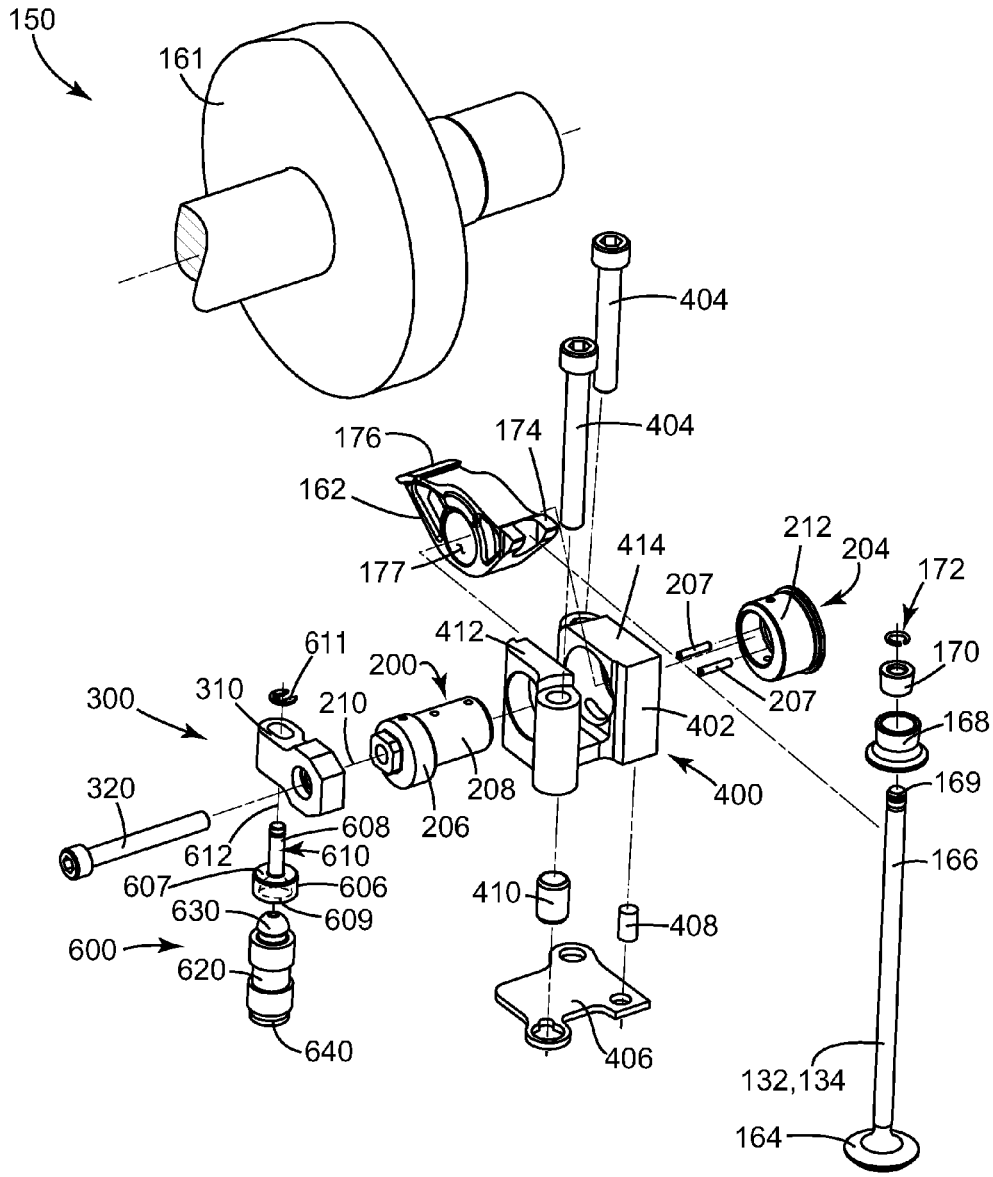

Referring to FIGS. 6, 7 and 8, a side view, perspective view and exploded view respectively of an exemplary embodiment of the cam driven actuation system 150 for crossover valves 132 and 134 are shown.

Referring to FIGS. 6 and 7, the valve train 152 for each crossover valve 132, 134 includes the cam 161, rocker 162 and crossover valves 132/134 as actuating elements. As shown in FIG. 8, each of the valves 132/134 includes a valve head 164 and a valve stem 166 extending vertically from the valve head. A collet retainer 168 is disposed at the distal tip 169 of the stem 166 and securedly fixed thereto with a collet 170 and clip 172.

Referring to FIG. 8, the rocker 162 includes a forked rocker pad 174 at one end, which straddles valve stem 166 and engages the underside of collet retainer 168. Additionally, rocker 162 also includes a solid rocker pad 176 at an opposing end, which slidingly contacts cam 161 of the valve train 152. Additionally, rocker 162 includes a rocker shaft bore 177 extending therethrough (see more detailed discussion below).

The forked rocker pad 174 of the rocker 162 contacts the collet retainer 168 of the outwardly opening poppet valves 132/134 such that a downward direction of the rocker pad 176 (direction A in FIGS. 6, 12 and 13) caused by the actuation of the cam 161 translates into an upward movement of the rocker pad 174 (direction B in FIGS. 6, 12 and 13), which opens the valves 132/134. A gas spring (not shown) acts on the valves 132/134 to keep the valves 132/134 closed when not driven by the rocker 162.

As shown in FIG. 6, valve lash in valve train 152 includes, but is not limited to, any clearances between the rocker 162 and the cam 161 and between the rocker 162 and the collett retainer 168 of the valves 132, 134. Specifically, clearance 178 is the clearance between collet retainer 168 and rocker pad 174. Additionally, clearance 180 is the clearance between cam 161 and rocker pad 176. In this embodiment, element clearances 178 and 180 substantially comprise the valve lash of the valve train 152. As will be explained herein below, valve lash adjustment system 160 adjusts the clearances 178 and 180 to a substantially zero clearance, and, therefore, adjusts the valve lash of valve train 152 to substantially zero.

Figure 9:
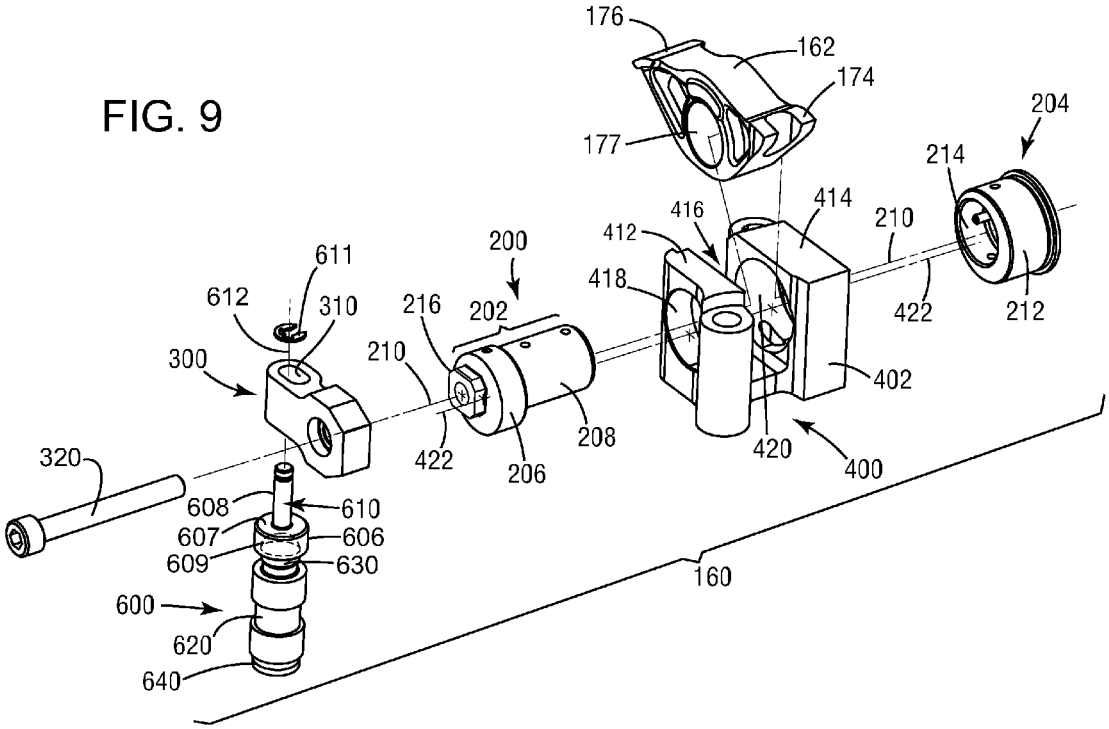
FIG. 9 shows an exploded view of some of the key components of the valve lash adjustment system.

In the present invention, the elements of the valve lash adjustment system 160 are mounted remotely relative to the valve train 152 in order to increase stiffness of the valve lash adjustment system, as explained further below. More specifically, no element of the valve lash adjustment system 160 is also an actuating element of the valve train 152, and no element of the valve lash adjustment system 160 is configured to directly impart primary actuation motion to the valves 132 and 134. As a result, the primary motion, if any, of the individual elements of the valve lash adjustment system 160 operate at slower rates than the actuation rates of valves 132 and 134. As shown in FIGS. 8 and 9, the valve lash adjustment system 160 includes rocker shaft assembly 200, which rotatably supports the rocker 162 of valve train 152, a rocker shaft lever 300, a pedestal assembly 400, which rotatably contains the rocker shaft assembly 200, and a lash adjuster assembly 600. In this exemplary embodiment, a hydraulic lash adjuster (HLA) assembly is used as the lash adjuster assembly 600. It should be noted that the HLA assembly is specific to this exemplary embodiment. One skilled in the art would recognize that other lash adjustment assemblies may used, e.g., pneumatic, mechanical or electrical lash adjust assemblies, or the like.

It is important to note that both the rocker shaft assembly 200 and the pedestal assembly 400, of the valve lash adjustment system 160, are also support elements of the valve train 152. That is, the pedestal assembly 400 and the rocker shaft assembly 200 both provide support for the rocker 162 and affect the overall stiffness of the valve train 152. However, the pedestal assembly 400 and the rocker shaft assembly 200 are not required to cycle at the same actuation rates or relative amplitudes as the actuating elements of valve train 152.

Figure 10:
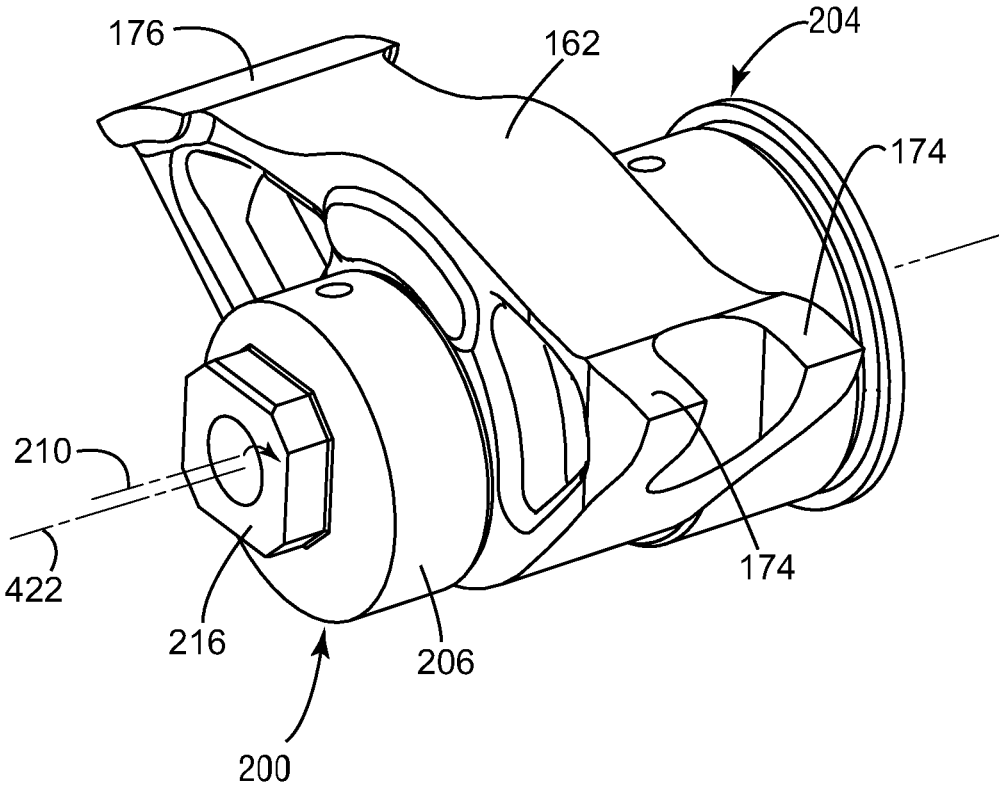
FIG. 10 is a perspective view of the rocker of the valve train only, and the rocker shaft of both the valve lash adjustment system and valve train.

As best seen in FIG. 10, the valve lash adjustment system 160 engages the valve train 152 only at the rocker 162. That is, rocker 162 pivotally rotates on a relatively stationary rocker shaft assembly 200. Note that rocker 162 is an element of the valve train 152 and is not an element of the valve lash adjustment system 160, whereas rocker shaft assembly 200 is both an element of the valve lash adjustment system 160 and a support element of the valve train 152. Accordingly, the rocker shaft assembly 200 does not directly impart primary actuation motion to valves 132 and 134 as an actuating element would, but rather acts as a relatively stationary shaft upon which rocker 152 pivots to actuate valves 132 and 134.

As best seen in FIGS. 8 and 9, the pedestal assembly 400 includes pedestal 402 that is rigidly secured to the engine block (not shown), for example with bolts 404, or other similar fasteners. The pedestal assembly 400 also includes a pedestal shim 406 having a predetermined thickness for accurately positioning the pedestal 402 relative to the valve train 152 in the vertical direction (direction of travel of valves 132, 134). Solid dowel 408 and hollow dowel 410 are utilized to accurately align the pedestal 402 relative to the valve train 152 in the horizontal direction.

Pedestal 402 has machined therein a front wall 412 and rear wall 414 defining a slot 416 therebetween. The pedestal slot 416 is sized to receive therein the rocker 162. The front wall 412 and rear wall 414 include a front bore 418 and a rear bore 420 formed therein respectively. Front and rear bores 418, 420 are concentric around a fixed axis 422, best shown in FIG. 9. Front and rear bores 418, 420 are sized to receive the rocker shaft assembly 200, as described in detail below.

The rocker shaft assembly 200 includes a rocker shaft 202 and an eccentric rocker shaft cap 204 that is fixedly secured to the rocker shaft 202 via pins 207 and bolt 320. The rocker shaft 202 includes a pedestal bearing portion 206 sized to be slip fit into front bore 418 such that the pedestal bearing portion 206 is concentric to the fixed axis 422. The rocker shaft 202 also includes a rocker bearing portion 208 which is sized to be received in the rocker bore 177 such that the rocker 162 rotates and pivots on the rocker bearing portion 208. When the rocker 162 is mounted onto the rocker bearing portion 208 with the rocker 162 inserted into the slot 416 formed in the pedestal 402 and the pedestal bearing portion 206 of the rocker shaft 202 is captured by the front bore 418, the rocker 162 rotates about rocker bearing portion 208 within the slot 416. As shown in FIG. 9, rocker bearing portion 208 is eccentric to the pedestal bearing portion 206 such that a center line of the rocker bearing portion 208 (the movable rocker axis 210) is offset from the fixed axis 422 by approximately 2 mm. Because the rocker 162 rotates on the rocker bearing portion 208, the rocker 162 rotates about this movable rocker axis 210 as it actuates the valves 132, 134.

Eccentric cap 204 includes an outer bearing surface 212 sized to slip fit into the rear bore 420 of the rear wall 414 of the pedestal 402 such that the outer bearing surface 212 is concentric with the fixed axis 422. Eccentric cap 204 additionally includes an eccentric inner bearing surface 214 that receives and captures the rocker bearing portion 208. The inner bearing surface 214 is concentric with the movable rocker axis 210.

Because the rocker bearing portion 208 is eccentric to the pedestal bearing portion 206 and the outer bearing surface 212, the rotation of the pedestal bearing portion 206 about the fixed axis 422 causes the rocker bearing portion 208 to move eccentrically with respect to the pedestal bearing portion 206 and the outer bearing surface 212. That is, the rotation of the pedestal bearing portion 206 about the fixed axis 422 (best seen in FIG. 14) causes the center of the rocker bearing portion 208 (the movable rocker axis 210) to move arcuately about the fixed axis 422, as described in more detail below with respect to FIGS. 12, 13 and 14. Since the rocker 162 rotates on the rocker bearing portion 208, this movement of the center 210 of the rocker bearing portion 208 adjusts the position of the rocker pad 176 relative to the cam 161, and the position of the rocker pad 174 relative to the collet retainer 168, thereby controlling the clearances 180, 178 and, therefore, the valve lash of valve train 152.

Figure 11:
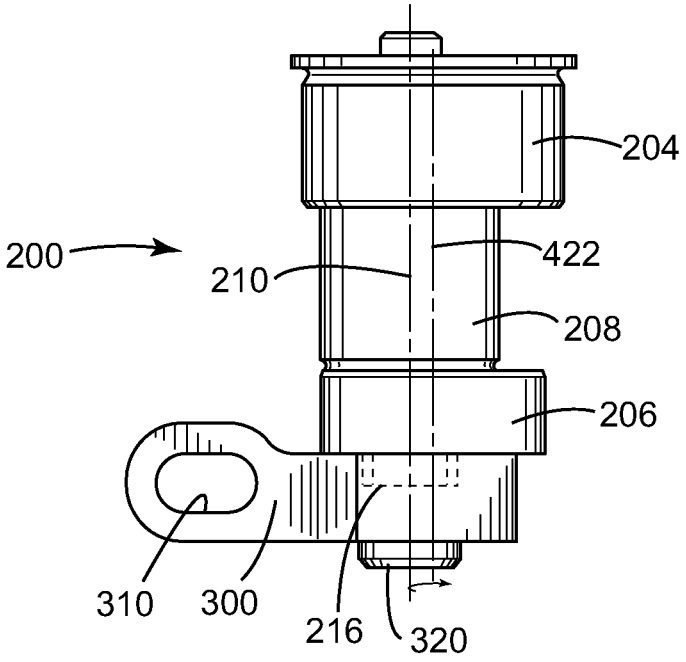
FIG. 11 is a top view of the rocker shaft and rocker shaft lever of the valve lash adjustment system.

The rotational angle of the rocker shaft assembly 200 is controlled by the rocker shaft lever 300, to which it is rigidly joined by screw 320 or other similar fastener. As best shown in FIG. 11, the screw 320 is aligned with the movable rocker axis 210. As shown in FIGS. 8 and 9, the rocker shaft lever 300 is coupled to the hydraulic lash adjuster (HLA) assembly 600 so that the rotational position of the rocker shaft lever 300 is controlled by the vertical deflection of the hydraulic lash adjuster (HLA) assembly 600. The HLA assembly 600 includes a connecting cap 610 that is disposed on an upper end of a hydraulic lash adjuster 620 (HLA 620). The connecting cap 610 includes a pin 608 extending vertically from a base 606. The base 606 further includes an upper surface 607 and a lower generally spherically-shaped socket 609. The pin 608 is contained in a clearance slot 310 of the rocker shaft lever 300. The lower socket 609 fits onto a generally spherically-tipped plunger 630 such that the cap 610 is free to rotate on the plunger 630. The upper surface 607 of cap 610 abuts flush against a lower surface of rocker shaft lever 300 such that the cap 610 is captured between the lever 300 and HLA plunger 630. Note that pin 608 is primarily used for ease of assembly and is not required to capture cap 610. Clip 611 is optionally fitted to further assist assembly. Pressurized hydraulic fluid (not shown) is fed into HLA 620 to extend plunger 630 which raises connecting cap 610, thereby rotating rocker shaft lever 300. End 640 of the hydraulic lash adjuster (HLA) assembly 600 is mounted to the cylinder head (not shown) as is well known. For the hydraulic lash adjuster 620, a Schaeffler F-56318-37 finger lever pivot element, or any other similar pivot element, can be used. As mentioned above, a hydraulic lash adjuster (HLA) assembly is used as the lash adjuster assembly 600 in this exemplary embodiment. It should be noted that the HLA assembly is specific to this exemplary embodiment. One skilled in the art would recognize that other lash adjustment assemblies may used, e.g., pneumatic, mechanical or electrical lash adjust assemblies, or the like.

Since the rocker 162 is part of the valve train 152, it must be made very stiff. Also, because the rocker 162 is subjected to the high frequency actuation motion of the drive train, its mass must be minimized. Accordingly, the rocker 162 is machined from steel or stiffer materials and includes reinforcing ribs, as shown in FIG. 10. The configuration of the rocker 162 can be determined by performing well-known finite element analysis calculations.

As shown best in FIG. 9, the rocker shaft assembly 200 includes a male connecting portion 216 attached to the pedestal bearing portion 206, which fits into a female connecting portion formed in the rocker shaft lever 300 so that the rocker shaft lever 300 and the rocker shaft assembly 200 rotate together about fixed axis 422. Therefore, translational movement of the plunger 630 along axis 612 causes rotation of the rocker shaft assembly 200. This rotation of the rocker shaft assembly 200 causes displacement of the rocker 162, which is coupled to the rocker bearing portion 208 of the rocker shaft assembly 200, as presented above.

The shape and orientation of the male connecting portion 216 of the rocker shaft assembly 200 and the corresponding shape and orientation of the female connecting portion of the rocker shaft lever 300 determine the orientation of the rocker shaft lever 300 relative to the rocker shaft assembly 200.

Figure 12:
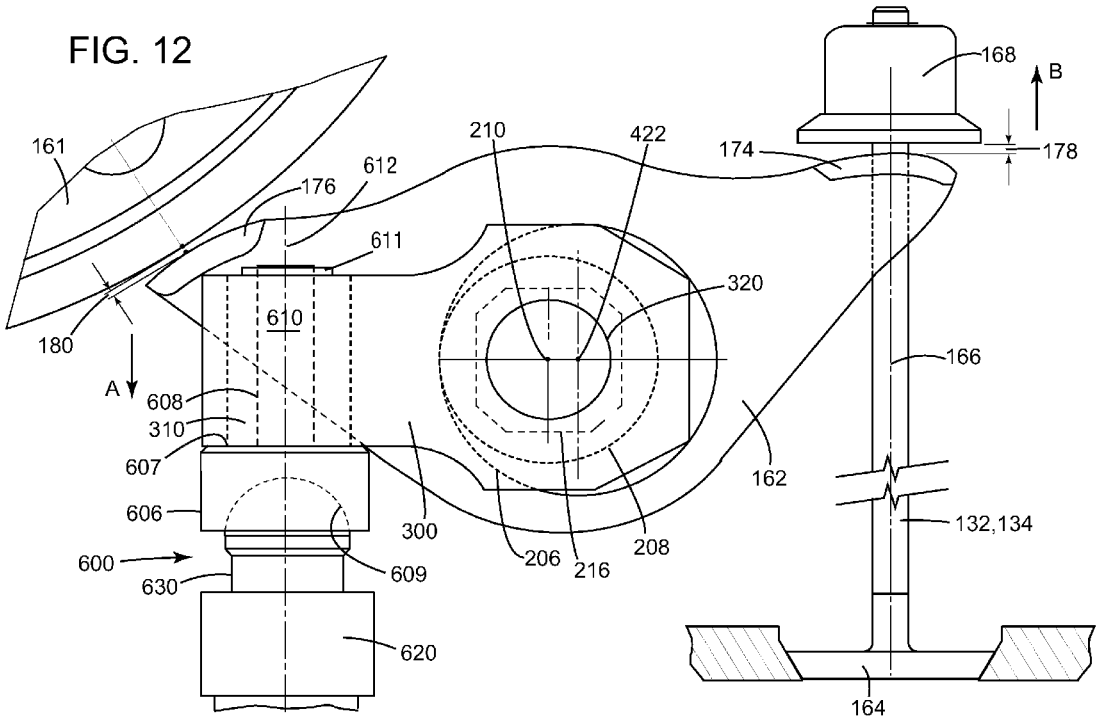
FIGS. 12 and 13 show the motion of the rocker arm of the valve lash adjustment system.
Figure 13:
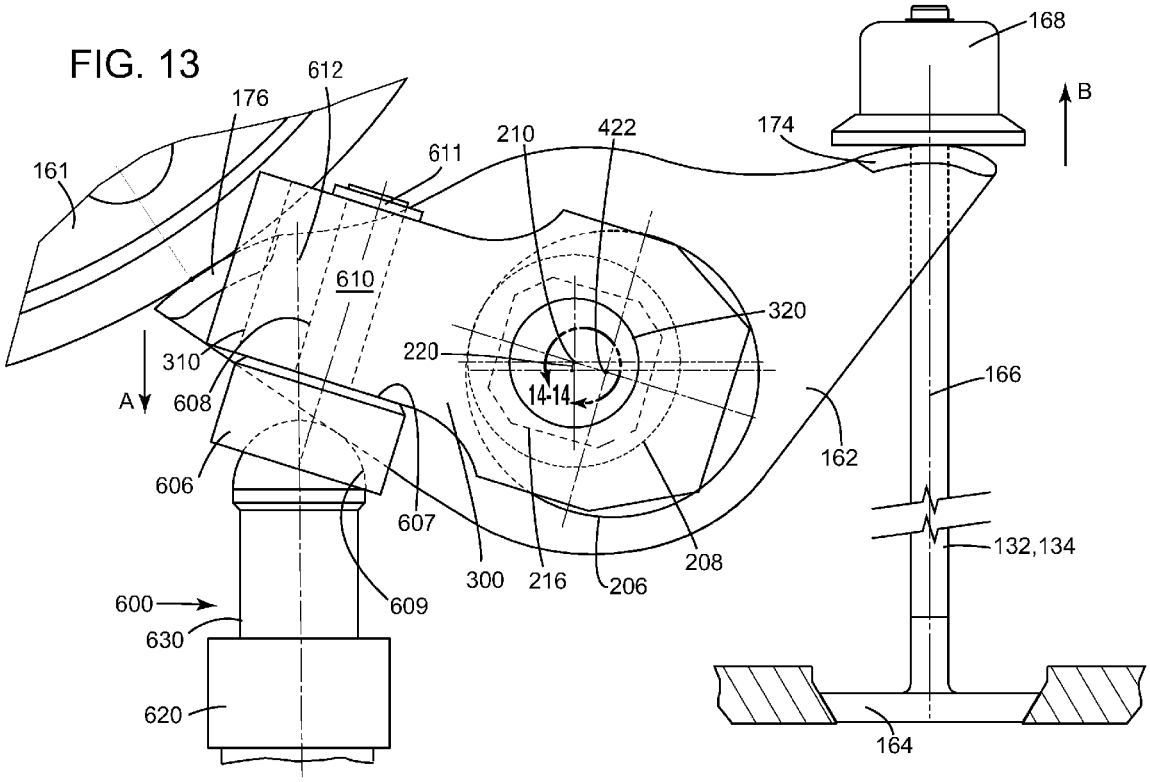
Figure 14:
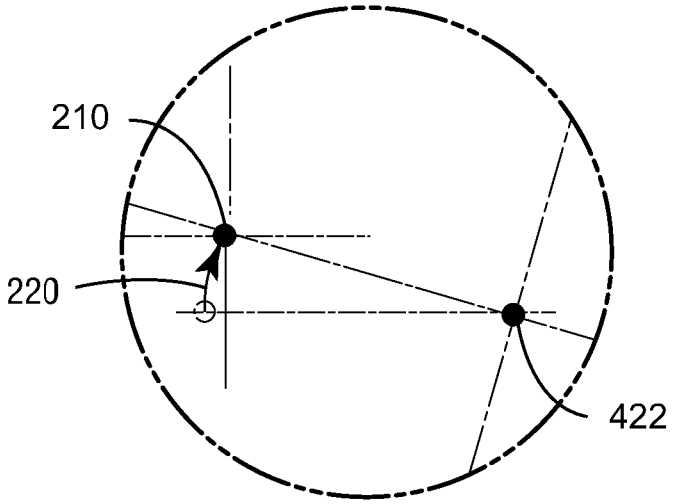
FIG. 14 is an enlarged view of center section 14-14 of FIG. 13.

As shown in FIGS. 12, 13 and 14, pressurized hydraulic fluid feeding into the HLA 620 causes the plunger 630 to extend outwardly toward a fully extended position from a fully retracted position relative to HLA 620. This results in the rotation of the rocker shaft lever 300, which causes an arcuate movement (as indicated by directional arrow 220 in FIGS. 13 and 14) of the movable rocker axis 210 of the rocker bearing portion 208 about the fixed axis 422. As can be best seen in FIG. 14, this arcuate movement 220 has both a vertical and horizontal component of direction. This results in a displacement of the rocker pad 176 of the rocker 162 towards the cam 161, and displacement of the rocker pad 174 towards collet retainer 168, thereby reducing the clearances 180 and 178 to substantially zero, as shown in FIG. 13. Accordingly, the valve lash, of which clearances 180 and 178 substantially comprise, is also reduced to substantially zero.

The embodiments described above describe a valve lash adjustment system 160 which reduces the lash to substantially zero, wherein there is contact between the cam 161 and the pad 176 of the rocker 162, which causes frictional drag. This contact between the cam 161 and the pad 176 will drain energy from the engine. Therefore, it may be desirable to include a friction reduction mechanism (not shown) to either reduce frictional drag or limit the lash to some non-zero minimum value in order to prevent contact between the cam 161 and the pad 176 of the rocker 162.

One such mechanism could be a non-rotating disc mounted to the camshaft by a bearing which holds the rocker pad 176 off of the base circle of the cam 161. Alternatively a fixed stop or rest for the rocker 162 could be rigidly mounted to the cylinder head 120 to separate the rocker pad 176 from the base circle of the cam 161. In the case of both the non-rotating disc and the fixed stop, it may be desirable that they have a coefficient of expansion approximately equal to the coefficient of expansion of the cam 161 to take into account the effects of thermal expansion. Alternatively, a roller could be added to the rocker pad 176 to reduce frictional drag between rocker 162 and cam 161.

For purposes herein, the following definitions will be referred to and applied:

1) stiffness (K600) of the HLA assembly 600: the ratio of the force (F600) applied to the HLA plunger 630 (by the rocker shaft lever 300) to the deflection (D600) of the plunger 630 (in the direction of the applied force) directly caused by the application of that force; and
2) stiffness (K200) of the rocker shaft assembly 200: the ratio of the force (F200) applied to the rocker shaft assembly 200 by the rocker 162 to the deflection (D200) of the rocker shaft assembly 200 (in the direction of the applied force) directly caused by the application of that force.

The stiffness of the rocker shaft assembly 200, i.e., K200, can be subdivided into the following two main components:

(A) the bending component (K200B), caused primarily by the deflection (D200B) resulting from the deformation of the various components of the rocker shaft assembly 200, but primarily due to the bending of rocker bearing portion 208; and (B) the rotating component (K200R), caused primarily by the deflection (D200R) resulting from the rotation of rocker shaft assembly 200 produced by the deflection of HLA assembly 600.

Additionally, the approximate relationship between K200R and K200B is as follows: 1/K200=1/K200R+1/K200B The bending component K200B is primarily controlled by the diameter of rocker bearing portion 208, and the distance between front and rear bores 418 and 420. The rotating component K200R is primarily controlled by the length of the rocker shaft lever 300 and by the distance between the moveable axis 210 and fixed axis 422. It is desirable to design the rotating component K200R such that it is greater than or equal to the bending component K200B.

The length of the rocker shaft lever 300 and the relative distances between the centerline 612, moveable axis 210 and fixed axis 422 creates an advantageous lever ratio (i.e., greater than 1, preferably greater than 3 and more preferably greater than 5). Specifically, in this exemplary embodiment, this lever ratio (LR) is defined as the ratio of (1) the shortest distance between the line of action of the force (F600) applied to the HLA 600 by rocker shaft lever 300 and the fixed axis 422 to (2) the shortest distance between the line of action of the force (F200) applied to the rocker shaft assembly 200 by the rocker 162 and fixed axis 422.

As the lever ratio increases above 1, it reduces the force from the rocker 162 onto the HLA assembly 600 (applied through rocker shaft lever 300), which increases the rotating component stiffness K200R relative to the HLA assembly stiffness K600 by approximately the square of the lever ratio in accordance with the following equations:

$$K600=F600/D600 \quad 1)$$

$$K200=F200/D200 \quad 2)$$

$$K200R=F200/D200R \quad 3)$$

$$K200B=F200/D200B \quad 4)$$

$$1/K200=1/K200R+1/K200B \quad 5)$$

$$D200=D200R+D200B \quad 6)$$

$$D600=F600/K600 \quad 7)$$

$$F600=F200/LR \quad 8)$$

$$D600=F200/(K600*LR) \quad 9)$$

$$D200R=D600/LR \quad 10)$$

$$D200R=F200/(K600*LR*LR) \quad 11)$$

$$K200R=K600*LR*LR \quad 12)$$

If the preferable lever ratio (LR) of approximately 10 to 1 is used, the force (F600) experienced by the plunger 630 of the HLA assembly 600 is only approximately one-tenth (1/10) of the force (F200) experienced by the rocker shaft assembly 200 (as described in equation 8). At the same time, the deflection (D600) in the general direction of axis 612 of the plunger 630 (due to the lever ratio of 10 to 1) is approximately 10 times the consequent deflection (D200R) in the general direction of axis 612 of the rocker shaft assembly 200 (as described in equation 10).

The overall result is that the lever ratio (LR) creates an effective increase in the rotating component (K200R) of the overall stiffness (K200) of the rocker shaft assembly 200 compared to the stiffness (K600) of the HLA assembly 600 that is approximately equal to the square of the lever ratio (as described in equation 12). One of the reasons that the relationship of stiffness k200R to stiffness K600 is approximately, rather than exactly, that of equation 12 is friction. For purposes herein, the term "approximately", as it applies to said square of said lever ratio, shall mean within 25 percent (or more preferably within 10 percent) of the value of said squared lever ratio. That is, if a lever ratio of approximately 10 to 1 is used (the preferred lever ratio), the rotating component stiffness K200R is approximately 100 times the HLA assembly stiffness K600. More specifically the stiffness of the rotating component K200R is preferably equal to or greater than 75 times the HLA assembly stiffness K600. More preferably, the stiffness of the rotating component K200R is equal to or greater than 90 times the HLA assembly stiffness K600.

As described above, the HLA assembly 600 is positioned remotely from the valve train 152, which includes the cam 161, rocker 162 and crossover valves 132/134 as actuating elements. Therefore, the primary motion of the rocker shaft lever 300 and the primary motion of the HLA assembly 600 will not be subject to the high frequency motion experienced by the actuating elements of the valve train 152 (about four to six times faster than the valves of a conventional engine). That is, the primary motion of the rocker shaft lever 300 and HLA assembly 600 (for example, the motion which compensates for variations in valve lash due to slower phenomenon, like thermal expansion, wear, HLA oil leakage and the like) will be at a much lower frequency than the primary motion of the actuating elements of the valve train 152. Accordingly, the mass of the rocker shaft lever 300 will not be constrained by the high frequency motion requirements of valve train 152. Therefore, the rocker shaft lever 300 can be made very stiff and bulky. Additionally, the lever ratio of rocker shaft lever 300 can be made very large, i.e., a lever ratio of 3 or greater, preferably a lever ratio of 5 or greater and most preferably a lever ratio of 7 or greater.

It should be noted that the rocker shaft lever 300 and HLA assembly 600 will be subject to some high frequency vibration caused by the high frequency movements of the valve train. However, the displacement induced by this vibration will have a magnitude that is substantially less than the magnitude of the displacement of the components in the valve train, typically by an order of magnitude less. The primary motion of the rocker shaft lever 300 and HLA assembly 600 in their lash adjustment function will have a frequency substantially less than that of the actuation motion of the actuating elements of the valve train 152.

Although the valve lash adjustment system 160 described herein operates in conjunction with outwardly opening valves of a split-cycle engine, it can be applied to the operation of any valve. More preferably, it can be applied to fast acting valves having a duration of actuation of approximately 3 ms and 180 degrees of crank angle, or less.

Although the invention has been described by reference to specific embodiments, it should be understood that numerous changes may be made within the spirit and scope of the inventive concepts described. For example, the valve lash adjustment system described herein is not limited to a cam-driven system. Accordingly, it is intended that the invention not be limited to the described embodiments, but that it have the full scope defined by the language of the following claims.

What is claimed is:

1. A valve actuation system comprising:

a valve train for actuating a valve, said valve train including a valve lash and a rocker;

a valve lash adjustment system for adjusting the lash of the valve train, the valve lash adjustment system including;

a rocker shaft assembly including a rocker shaft operable to rotatably support the rocker, wherein the rocker shaft includes a pedestal bearing portion that is concentric to a fixed axis, and a rocker bearing portion on which the rocker rotates, the rocker bearing portion being concentric to a movable rocker axis, wherein the movable rocker axis is offset from the fixed axis;

a rocker shaft lever secured to the rocker shaft so that a rotational position of the rocker shaft is operable to be determined by a rotational position of the rocker shaft lever; and a lash adjuster assembly, which is operable to exert a force on the rocker shaft lever so as to adjust the rotational position of the rocker shaft lever, thereby controlling the rotational position of the rocker shaft and displacing the rocker, which modifies the lash, wherein a lever ratio defined as a ratio of (1) a shortest distance between a line of action of a force applied to the lash adjuster assembly by the rocker shaft lever and the fixed axis to (2) a shortest distance between a line of action of a force applied to the rocker shaft assembly by the rocker and the fixed axis is 10:1, thereby reducing a force from the rocker onto the lash adjuster assembly and increasing the effective stiffness of the lash adjuster assembly.

2. The valve actuation system of claim 1, operable such that a force experienced by the lash adjuster assembly is significantly less than a force experienced by the rocker.

3. The valve actuation system of claim 1, further comprising:

a pedestal frame into which the rocker shaft is inserted, wherein the pedestal frame includes a front bore that rotatably supports the pedestal bearing portion and a slot that receives the rocker.

4. The valve actuation system of claim 3, further including a pedestal shim for positioning the pedestal relative to the valve train in a vertical direction.

5. The valve actuation system of claim 3, further including an eccentric cap including an outer bearing surface sized to slip fit into a rear bore of a rear wall of the pedestal frame such that the outer bearing surface is concentric with the fixed axis, and including an eccentric cap including an eccentric inner bearing surface that receives the rocker bearing portion.

6. The valve actuation system as set forth in claim 1, further including:

a rocker shaft tappet disposed on an upper end of the lash adjuster assembly, wherein the rocker shaft tappet is contained in a clearance slot formed in the rocker shaft lever, wherein a side clearance is provided in the slot between the rocker shaft tappet and edges of the slot, thereby enabling the lash adjuster assembly to remain vertical and minimizing side forces.

7. The valve actuation system of claim 1, wherein the valve lash adjustment system engages the valve train only at the rocker.

8. The valve actuation system of claim 1, wherein the mass of the rocker is selected so that the valve actuation system can subject the rocker to high frequency actuation motion.

9. The valve actuation system of claim 1, wherein the rocker is substantially made of steel.

10. The valve actuation system of claim 1, wherein the rocker includes reinforcing ribs.

11. A valve lash adjustment system for adjusting a lash of a valve train including a rocker, said valve lash adjustment system comprising:

a rocker shaft assembly including a rocker shaft operable to rotatably support the rocker, wherein the rocker shaft includes a pedestal bearing portion that is concentric to a fixed axis, and a rocker bearing portion on which the rocker rotates, the rocker bearing portion being concentric to a movable rocker axis, wherein the movable rocker axis is offset from the fixed axis;

a rocker shaft lever secured to the rocker shaft so that a rotational position of the rocker shaft is operable to be determined by a rotational position of the rocker shaft lever; and a lash adjuster assembly, which is operable to exert a force on the rocker shaft lever so as to adjust the rotational position of the rocker shaft lever, thereby controlling the rotational position of the rocker shaft and displacing the rocker, which modifies the lash, wherein a lever ratio defined as a ratio of (1) a shortest distance between a line of action of a force applied to the lash adjuster assembly by the rocker shaft lever and the fixed axis to (2) a shortest distance between a line of action of a force applied to the rocker shaft assembly by the rocker and the fixed axis is 10:1, thereby reducing a force from the rocker onto the lash adjuster assembly and increasing the effective stiffness of the lash adjuster assembly.

12. The valve lash adjustment system of claim 11, operable such that a force experienced by the lash adjuster assembly is significantly less than a force experienced by the rocker.

13. The valve lash adjustment system of claim 11, further comprising:

a pedestal frame into which the rocker shaft is inserted, wherein the pedestal frame includes a front bore that rotatably supports the pedestal bearing portion and a slot that receives the rocker.

14. The valve lash adjustment system of claim 13, further including a pedestal shim for positioning the pedestal relative to the valve train in a vertical direction.

15. The valve lash adjustment system of claim 13, further including an eccentric cap including an outer bearing surface sized to slip fit into a rear bore of a rear wall of the pedestal frame such that the outer bearing surface is concentric with the fixed axis, and including an eccentric cap including an eccentric inner bearing surface that receives the rocker bearing portion.

16. The valve lash adjustment system as set forth in claim 11, further including:

a rocker shaft tappet disposed on an upper end of the lash adjuster assembly, wherein the rocker shaft tappet is contained in a clearance slot formed in the rocker shaft lever, wherein a side clearance is provided in the slot between the rocker shaft tappet and edges of the slot, thereby enabling the lash adjuster assembly to remain vertical and minimizing side forces.

17. The valve lash adjustment system of claim 11, wherein the valve lash adjustment system engages the valve train only at the rocker.

18. The valve lash adjustment system of claim 11, wherein the mass of the rocker is selected so that the valve actuation system can subject the rocker to high frequency actuation motion.

19. The valve lash adjustment system of claim 11, wherein the rocker is substantially made of steel.

20. The valve lash adjustment system of claim 11, wherein the rocker includes reinforcing ribs.

21. A valve actuation system comprising:

a valve train for actuating a valve, said valve train including actuating elements and a valve lash; and a valve lash adjustment system for adjusting the valve lash, said valve lash adjustment system comprising a rocker shaft assembly rotatable about a fixed axis and operatively connected to the valve train, the rocker shaft assembly including a rocker bearing portion which provides a movable axis offset from the fixed axis, a lash adjuster assembly operable to modify the valve lash, the lash adjuster assembly extendable along a centerline axis, and a rocker shaft lever operatively connected between the lash adjuster assembly and the rocker shaft assembly to provide a lever ratio;

wherein said valve train and said valve lash adjustment system do not share any common actuating elements and wherein the rocker shaft assembly has a stiffness that includes: a bending component caused by at least a deflection resulting from deformation of the rocker bearing portion; a rotating component caused by at least a deflection resulting from rotation of the rocker shaft assembly, and the lash adjuster assembly has a stiffness that is within 25 percent of the stiffness of the rotating component multiplied by the square of the lever ratio.

22. The valve actuation system of claim 21, wherein the lever ratio is equal to or greater than 3.

23. The valve actuation system of claim 21, wherein the lever ratio is equal to or greater than 5.

24. The valve actuation system of claim 21, wherein the lever ratio is equal to or greater than 7.

25. The valve actuation system of claim 21, wherein the rotating component is greater than or equal to the bending component.

26. The valve actuation system of claim 21, wherein the rocker shaft assembly is a support element of the valve train.

27. A valve lash adjustment system for adjusting a valve lash of a valve train for actuating a valve, said valve lash adjustment system comprising:

a lash adjuster assembly for adjusting the valve lash, said valve lash adjustment system comprising a rocker shaft assembly rotatable about a fixed axis and operatively connected to the valve train, the rocker shaft assembly including a rocker bearing portion which provides a movable axis offset from the fixed axis, a lash adjuster assembly operable to modify the valve lash, the lash adjuster assembly extendable along a centerline axis, and a rocker shaft lever operatively connected between the lash adjuster assembly and the rocker shaft assembly to provide a lever ratio, wherein said valve train and said valve lash adjustment system do not share any common actuating elements and wherein the rocker shaft assembly has a stiffness that includes: a bending component caused by at least a deflection resulting from deformation of the rocker bearing portion; a rotating component caused by at least a deflection resulting from rotation of the rocker shaft assembly, and the lash adjuster assembly has a stiffness that is within 25 percent of the stiffness of the rotating component multiplied by the square of the lever ratio.

28. The valve lash adjustment system of claim 27, wherein the lever ratio is equal to or greater than 3.

29. The valve lash adjustment system of claim 27, wherein the lever ratio is equal to or greater than 5.

30. The valve lash adjustment system of claim 27, wherein the lever ratio is equal to or greater than 7.

31. The valve lash adjustment system of claim 27, wherein the rotating component is greater than or equal to the bending component.

32. The valve lash adjustment system of claim 27, wherein the rocker shaft assembly is a support element of the valve train.

33. A valve actuation system comprising:

a valve train for actuating a valve, said valve train including actuating elements and a valve lash; and a valve lash adjustment system for adjusting the valve lash, said valve lash adjustment system comprising a rocker shaft assembly rotatable about a fixed axis and operatively connected to the valve train, the rocker shaft assembly including a rocker bearing portion which provides a movable axis offset from the fixed axis, a lash adjuster assembly operable to modify the valve lash, the lash adjuster assembly extendable along a centerline axis, and a rocker shaft lever operatively connected between the lash adjuster assembly and the rocker shaft assembly to provide a lever ratio;

wherein said valve train and said valve lash adjustment system do not share any common actuating elements and wherein the rocker shaft assembly has a stiffness that includes: a bending component caused by at least a deflection resulting from deformation of the rocker bearing portion; a rotating component caused by at least a deflection resulting from rotation of the rocker shaft assembly, and the lash adjuster assembly has a stiffness that is within 10 percent of the stiffness of the rotating component multiplied by the square of the lever ratio.

34. A valve lash adjustment system for adjusting a valve lash of a valve train for actuating a valve, said valve lash adjustment system comprising:

a lash adjuster assembly for adjusting the valve lash, said valve lash adjustment system comprising a rocker shaft assembly rotatable about a fixed axis and operatively connected to the valve train, the rocker shaft assembly including a rocker bearing portion which provides a movable axis offset from the fixed axis, a lash adjuster assembly operable to modify the valve lash, the lash adjuster assembly extendable along a centerline axis, and a rocker shaft lever operatively connected between the lash adjuster assembly and the rocker shaft assembly to provide a lever ratio, wherein said valve train and said valve lash adjustment system do not share any common actuating elements and wherein the rocker shaft assembly has a stiffness that includes: a bending component caused by at least a deflection resulting from deformation of the rocker bearing portion; a rotating component caused by at least a deflection resulting from rotation of the rocker shaft assembly, and the lash adjustment system has a stiffness that is within 10 percent of the stiffness of the rotating component multiplied by the square of the lever ratio.

* * * * *